US005336064A

United States Patent [19]

Lamers

[11] Patent Number: 5,336,064

[45] Date of Patent: Aug. 9, 1994

[54] ELECTRIC MOTOR DRIVEN PUMP

[75] Inventor: Robert P. Lamers, Murrysville, Pa.

[73] Assignee: Westinghouse Electric Corporation, Pittsburgh, Pa.

[21] Appl. No.: 162,247

[22] Filed: Dec. 6, 1993

[51] Int. Cl.[5] ..... F04B 17/00

[52] U.S. Cl. ..... 417/423.3; 417/423.14

[58] Field of Search ..... 417/423.3 O, 423.7, 417/423.8, 423.11, 423.14

[56] References Cited

U.S. PATENT DOCUMENTS

| | | | |
|---|---|---|---|
| 2,545,422 | 3/1951 | Blom | 417/423.11 |
| 4,886,430 | 12/1989 | Veronesi et al. | 417/423.13 |
| 5,061,157 | 10/1991 | Arakawa | 417/423.3 |
| 5,074,764 | 12/1991 | Kobayashi et al. | 417/423.3 |
| 5,101,128 | 3/1992 | Veronesi et al. | 310/54 |
| 5,118,466 | 6/1992 | Raymond et al. | 376/404 |

OTHER PUBLICATIONS

Framo Electric Pump Sales Brochure, Jan. 1993.

*Primary Examiner*—Richard A. Bertsch
*Assistant Examiner*—Alfred Basichas
*Attorney, Agent, or Firm*—Joseph C. Spadacene

[57] ABSTRACT

An electric motor driven pump for pumping a hazardous liquid includes an electric motor having a housing, energizing means surrounded by the housing and a rotatable output shaft extending from the housing. The housing contains a non-hazardous liquid that displaces oxygen in the housing so that explosions due to an electrical spark caused by failure of the electric motor is resisted. The pump further includes an impeller connected to the output shaft for pumping the hazardous liquid and an outer shell surrounding the electric motor. The outer shell and the electric motor define an outer space which contains an inert atmosphere and which isolates the electric motor from the hazardous liquid that is being pumped. In this way, explosions due to an electrical spark caused by failure of the electric motor and the presence of a hazardous liquid vapor are further resisted.

20 Claims, 6 Drawing Sheets

ELECTRIC MOTOR DRIVEN PUMP

BACKGROUND OF THE INVENTION

This invention relates to an electric motor driven pump and more particularly to a pump for pumping hazardous liquids, such as petroleum and chemical products, from the cargo area of a tanker ship, for example.

The transportation of bulk quantities of various petroleum products, including crude and refined derivative fluids, liquefied gases and a wide array of chemicals has been accomplished by ocean transport for decades. Many of these fluids are hazardous to humans and the environment by being toxic, explosive or both. Once the cargo is delivered to a receiving terminal, it is necessary to pump the cargo from the tanks and then through piping to land based storage facilities. Because of the hazardous characteristics of the cargos, specialized centrifugal pumps have been designed and developed to safely accomplish this function.

One method of pumping hazardous liquids from ocean tankers has been to use electric motor driven deep well pumps. These pumps include an electric motor of explosion proof design, which is mounted on the tanker deck, that is connected to a centrifugal pump located in a sump at the bottom of the cargo tank. It will be appreciated that the electric motor must be separated from the hazardous liquid to be pumped in order to prevent explosion which may be caused when a spark is produced by the failure of the electric motor. Thus, the motor and the pump are connected by a long shaft. Numerous sleeve-type bearings are required to position and support the long shaft. It is also difficult to maintain the necessary alignment of these bearings and thus maintenance must be frequently performed on these components. The sleeve-type bearings are lubricated by the fluid being pumped. Thus, the useful life of these bearings is influenced by the lubrication characteristics of the liquid and/or the amount and characteristics of foreign particles carried by the liquid.

The only currently accepted use of an electric motor prime mover close coupled to a centrifugal pump which is submerged in the pumped hazardous liquid is for liquefied gas applications. In this specific application, the motor cavity of the device is flooded with the pumped hazardous liquid. The absence of an oxidizer in the presence of a potential electrical discharge eliminates the hazard of an explosion. However, a significant weakness of this design is that the lubricating properties of the pumped hazardous liquid are quite poor for the rolling element bearings which are used for this application. Bearing failures are not uncommon. Furthermore, for safety reasons, operation of the pump is limited by the requirement that the motor must be de-energized once the cover gas above the hazardous liquid free surface starts to be drawn into the pump. It is standard practice not to empty the tank. In this manner, the operational temperature and the oxidizer deleted vapor within the tank are maintained.

Close coupled, hydraulic motor driven centrifugal pumps are permitted to be operated while submerged in the cargo tank. There are no sources of ignition when using this pumping system. However, a high pressure (up to 3,000 psi), complicated and difficult to maintain oil system is required to provide the energy to the hydraulic motor.

Thus, there remains a need for a electric motor driven pump that can be safely used to pump hazardous liquids from a product or chemical tanker.

SUMMARY OF THE INVENTION

The electric motor driven pump for pumping a hazardous liquid has met the above need. The pump includes an electric motor having a housing, energizing means surrounded by the housing and a rotatable output shaft extending from the housing. The housing contains a non-hazardous liquid that displaces oxygen in the housing so that explosions due to an electrical spark caused by failure of the electric motor are resisted. The pump further includes an impeller connected to the output shaft for pumping the hazardous liquid and an outer shell surrounding the electric motor. The outer shell and the electric motor define an outer space which contains an inert atmosphere and which isolates the electric motor from the hazardous liquid that is being pumped. In this way, explosions due to an electrical spark caused by failure of the electric motor and the presence of a hazardous liquid vapor are further resisted.

BRIEF DESCRIPTION OF THE DRAWINGS

A full understanding of the invention can be gained from the following description of the preferred embodiment when read in conjunction with the accompanying drawings in which.

DETAILED DESCRIPTION

Figure 1:
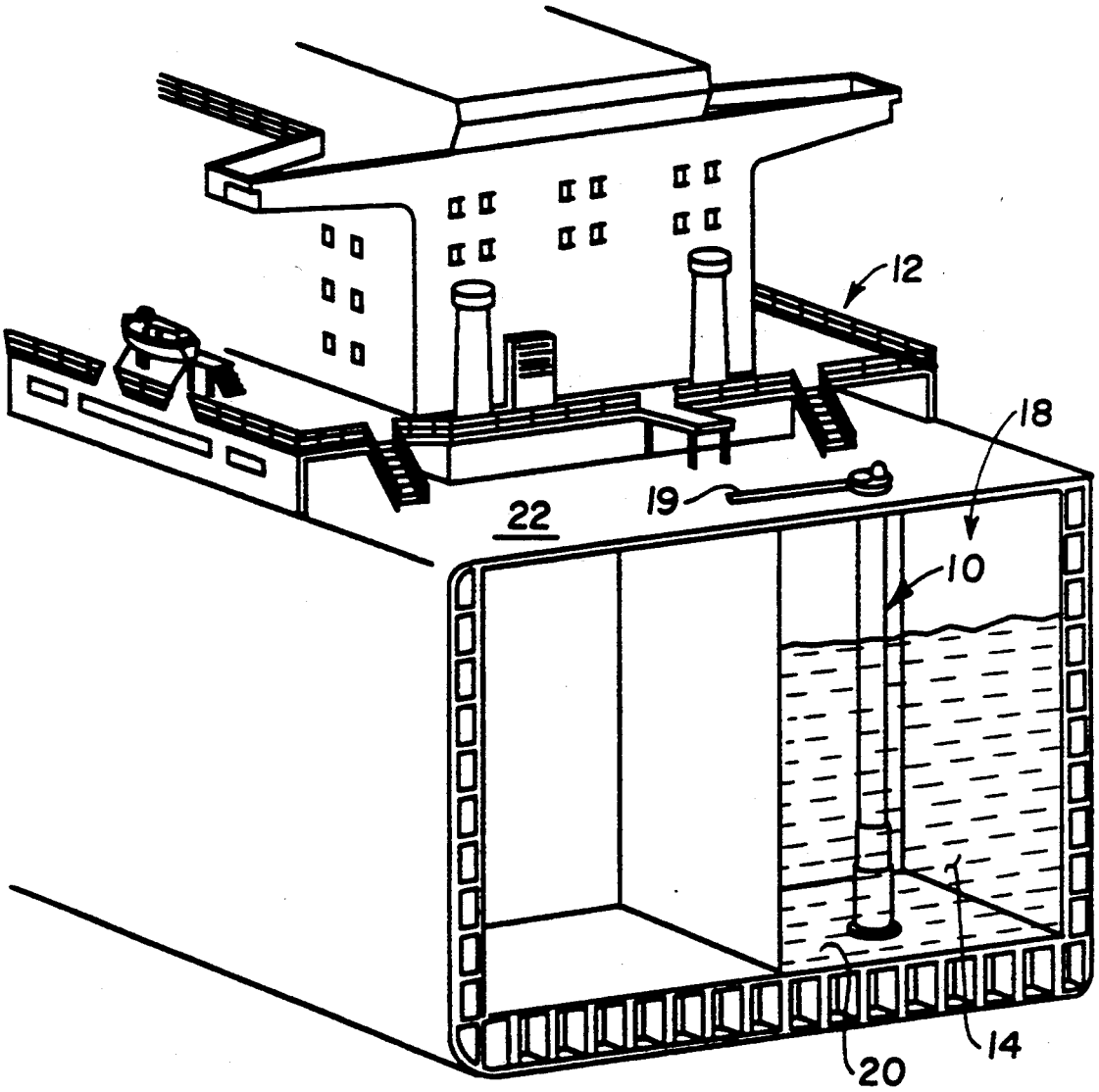
FIG. 1 is a perspective view partially in section, of the pump of the invention as positioned in the tank.

Referring to FIG. 1, the pump 10 of the invention is shown in use on an ocean tanker 12 carrying a hazardous liquid 14, such as a petroleum product. The ocean tanker 12 has numerous tanks, such as tank 18 in which the pump 10 of the invention is disposed. The pump 10 is used to pump the hazardous liquid 14 from the tank 18 to a receiving terminal (not shown). The hazardous liquid 14 is pumped from the tank 18 and then through piping 19 on the tanker 12 to land based storage facilities (not shown).

A typical tank 18 has a capacity of typically 800,000 gallons of hazardous liquid 14 and can be anywhere from forty to sixty feet deep. As can be seen from FIG. 1, the pump 10 is generally cylindrical in shape and extends from the floor 20 of the tank 18 to the deck 22 of the ocean tanker 12. The pump 10 is submersed in the hazardous liquid 14 with the motor and close coupled pump means (see FIG. 2) being disposed near the floor 20 of the tank 18. In this way, all of the hazardous liquid 14 in the tank 18 can be pumped from the tank 18 to piping 19 and eventually to land based storage.

As used herein, the term "hazardous liquid" means any liquid having a flash point temperature below 60° C. Examples of hazardous liquids 14 are petroleum products, liquefied gases and a wide array of chemicals. It will be appreciated that when handling hazardous liquids the possibility of explosion is always present. The hazardous liquid is a fuel which in combination and in the correct proportion with an oxidizer plus an ignition source (such as a spark from an electric motor) can cause an explosion. Explosions can be avoided if one of these elements is taken away. Obviously, the hazardous liquid 14 is always present and although there are numerous precautions designed to eliminate ignitors (such as electrical sparks caused by electric motor failures) the possibility of an ignition source must always be assumed. Therefore, the key is to limit the amount of oxygen in the vicinity of the hazardous liquid and ignitors to preferably less than 5% by volume (an "inert atmosphere") and thus prevent explosions. The pump 10 of the invention is designed to reduce the presence of oxygen in areas where an electrical spark can arise to create an inert atmosphere (in terms of flammability) so as to resist explosions from occurring when pumping the hazardous liquid 14.

Figure 2:
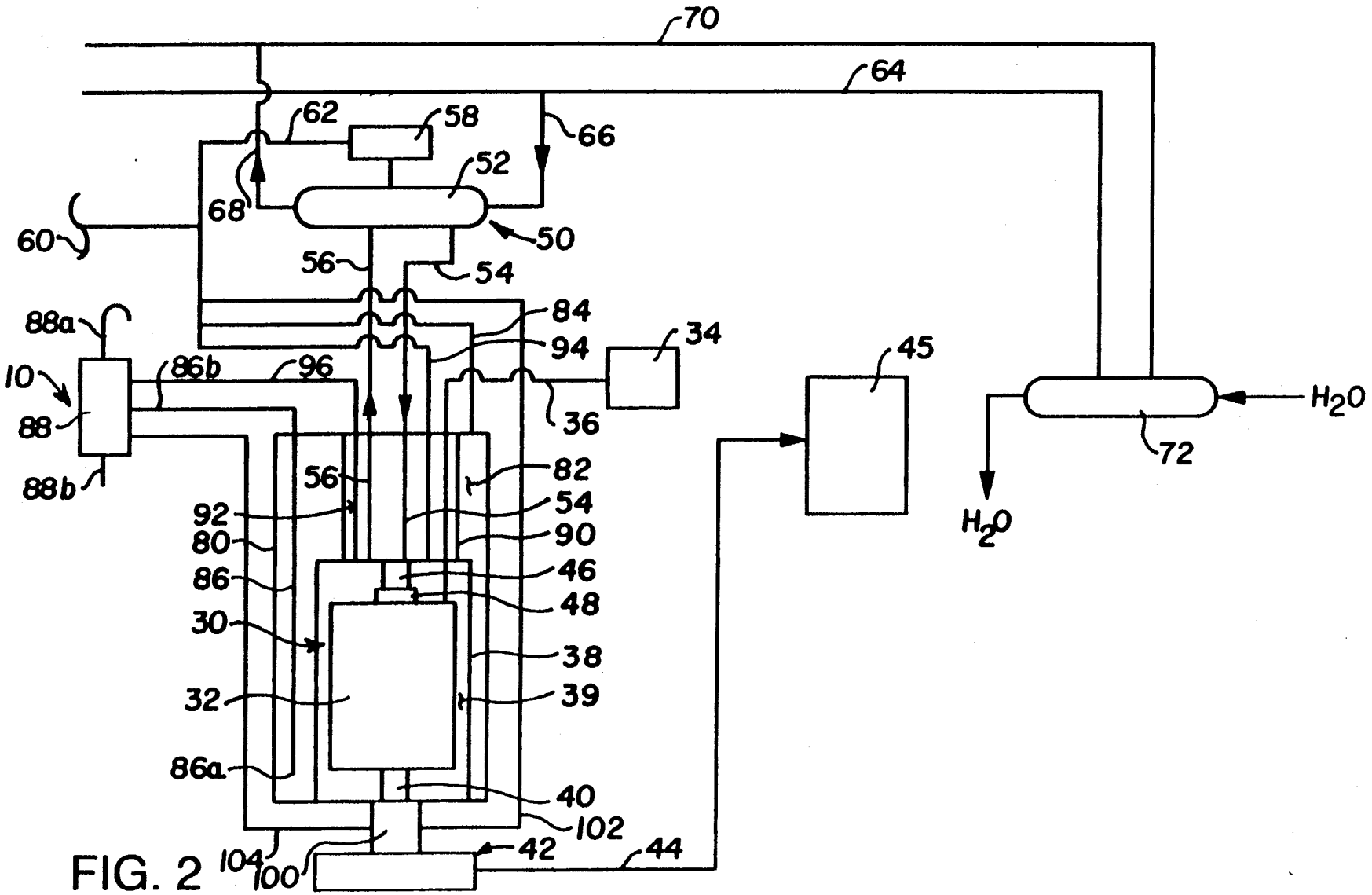
FIG. 2 is a schematic diagram of the pump system.

Referring now to FIG. 2, a schematic diagram of the pump 10 of the invention is shown. The driving means for the pump 10 is electric motor means 30 having conventional energizing means 32 consisting of stator windings and a rotor. The electric motor means 30 is a conventional three-phase AC induction type motor which is supplied electrical energy from an energy source 34 through electrical cables 36. The energizing means 32 of the electric motor 30 is surrounded by a motor housing 38. The motor housing 38 forms a motor space 39 in which the energizing means 32 is disposed. The energizing means 32 has an output shaft 40 which is connected to the impeller of conventional centrifugal pump means 42. It will be appreciated that the hazardous liquid is pumped from the pump means 42 and out of the tank 18 into cargo pipe 44 and eventually to land based storage facilities 45.

The energizing means 32 also includes an auxiliary shaft 46 extending from the end opposite of the output shaft 40. The auxiliary shaft 46 drives the auxiliary pump means 48, which will be discussed in detail with respect to FIG. 3*c*.

The motor housing 38 is completely filled with a non-hazardous liquid that displaces oxygen in the motor housing 38 so that explosions due to an electrical spark caused by failure of the electric motor means are resisted. The non-hazardous liquid is supplied to the motor space 39 from a circulating means 50. The circulating means 50 includes a conventional shell and tube heat exchanger 52 for cooling the non-hazardous liquid, an inlet pipe 54 for transporting the cooled non-hazardous liquid from the heat exchanger 52 to the motor space 39, an outlet pipe 56 for transporting the heated non-hazardous liquid from the motor space 39 and returning the non-hazardous liquid to the heat exchanger 52 and the auxiliary pump means 48 mounted on the auxiliary shaft 46 of the electric motor 30 for pumping the non-hazardous liquid from the inlet pipe 54 through the motor space 39 and out of the motor space 39 through the outlet pipe 56 to the heat exchanger 52.

Although an explosion will not occur in the motor space 39 due to an electrical failure in the motor 30, the electrical failure will cause a rapid short duration pressure rise within the motor space 39. Pressure relief valves and rupture disks (not shown) are incorporated into the motor means 30 to dissipate the pressure below a level Which would cause structural damage by allowing the non-hazardous liquid to enter the large volume of the conduit space 92 (discussed below).

The circulating means 50 also includes a head tank 58. The head tank 58 contains an amount of non-hazardous liquid and also a pressurized inert gas from an inert gas supply 60 which is delivered to the head tank 58 by gas line 62. The inert gas is preferably a mixture of 5% oxygen and 95% nitrogen (percentages are volume percents). The head tank 58 insures that the non-hazardous liquid in the motor housing is maintained at a constant pressure.

The heat exchanger 52 is a conventional shell and tube heat exchanger in which the heated non-hazardous liquid is cooled by transporting it through tubes surrounded by a coolant such as liquid ethylene glycol/water mixture. The heat exchanger 52 is separated from the pump 10 and the hazardous liquid 14 and is preferably disposed on the deck 22 of the tanker 12. The ethylene glycol/water mixture is provided from a supply line 64 and is delivered to the heat exchanger 52 by an inlet pipe 66, circulated through the heat exchanger 52 and discharged through outlet pipe 68 to a return line 70. The ethylene glycol/water mixture itself is then cooled by a similar shell and tube heat exchanger 72, which uses water as a coolant medium. It will be appreciated that the ethylene glycol/water mixture can be supplied to numerous shell and tube heat exchanger to service other pumps used in other tanks 18 on the ocean tanker 12.

An outer shell 80 surrounds the electric motor means. The outer shell 80, the conduit shell 90 and the electric motor means 30 define an outer space 82 which contains an inert atmosphere and which isolates the electric motor means from the hazardous liquid 14. This further resists explosions that may be caused due to an electrical spark caused by failure of the electric motor means 30.

Before the inert gas is introduced into the outer space 82, the outer space 82 is filled with atmospheric air which consists of about 21% oxygen. The introduction of the inert gas will dilute the oxygen content in the outer space 82. It has been determined that introducing an amount of inert gas equal to ten times the volume of the outer space 82 produces an inert atmosphere (in terms of flammability) in the outer space 82 having an air mixture of about 5% oxygen and 95% nitrogen. The inert gas is introduced into outer area 82 from nitrogen gas supply 60 through gas line 84. The displaced air is taken out of the outer space 82 by an outlet tube 86 disposed in the outer space 82. The outlet tube 86 has an open end 86*a* disposed in the outer space 82 to receive the displaced air. The other end 86*b* of the outlet tube 86 is connected to an exhaust trap 88 in which the air is vented through vent 88*a* to the atmosphere. The exhaust trap 88 also entraps liquid that may be present in the outer space 82 and that was subsequently entrained in the air flow. This liquid is drained from the exhaust trap 88 by drain 88*b*.

The pump 10 also includes a conduit shell 90 which surrounds the inlet pipe 54, outlet pipe 56 and the electric cables 36. Similarly to the outer shell 80, the conduit shell 90 defines a conduit space 92 that has an inert atmosphere. Inert gas from inert gas supply 60 is delivered to the conduit space 92 by gas line 94. As with the outer space 82, the conduit space 92 is flushed with an amount of inert gas equal to ten times the volume of the conduit space 92. This produces an inert atmosphere consisting of about 95% nitrogen and 5% oxygen. The displaced air is taken from conduit space 92 by outlet tube 96 and delivered to exhaust trap 88. The conduit space 92 inert atmosphere also resists explosions due to an electrical spark caused by failure of the electric motor such as sparks created at the connection point of the electric cables 36 with the energizing means 32.

Another feature of pump 10 is the collection reservoir 100 disposed between the electric motor 30 and the pump means 42. The collection reservoir 100 receives any leaked non-hazardous liquid from the electric motor 30 and any leaked hazardous liquid from the pump means 42. The collection reservoir 100 is purged by introducing inert gas from inert gas supply 60 through gas line 102 into the collection reservoir 100. The displaced inert gas, liquids and vapors are discharged into purge line 104 and then to exhaust trap 88.

Now that the basic operation of the pump has been explained by reference to a schematic drawing, the following discussion will focus on FIGS. 3*a*, 3*b* and 3*c* which will describe in detail the operation of the pump.

Figure 3A:
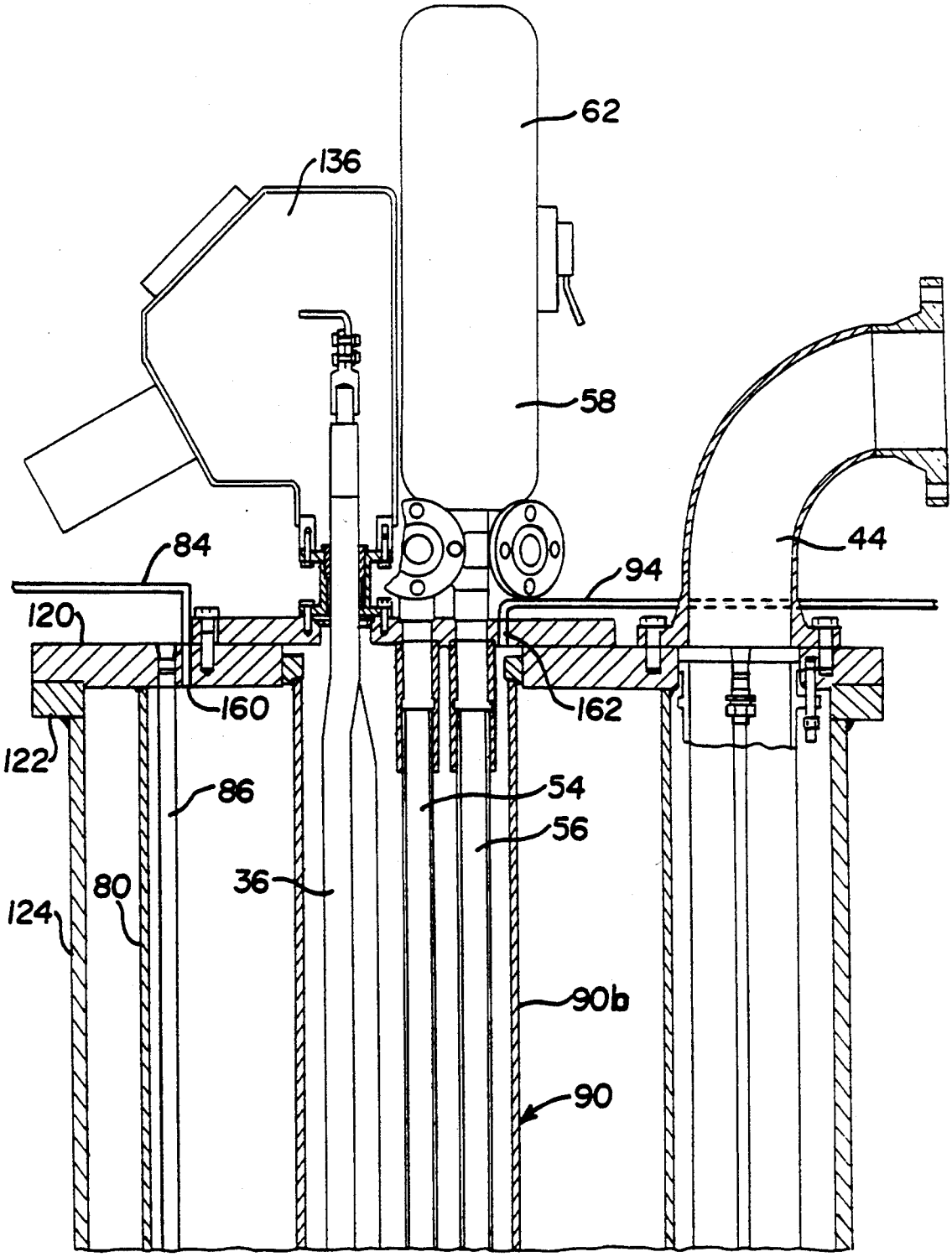
FIGS. 3*a*, 3*b* and 3*c* are a vertical cross-section of the pump of the invention.

Referring now more particularly to FIG. 3*a*, a vertical cross-sectional view of the upper section of the pump 10 is shown. The pump 10 includes a horizontal flange 120 which is secured to the flange 122 of a support column 124 extending from the deck 22 of the ocean tanker 12. In this way, the pump 10 is suspended in the tank 18. The outer shell 80 is shown in FIG. 3*a* as being welded to the undersurface of the flange 120. The outer shell 80 extends almost the entire length of the pump 10 and is welded at its lower end to a pump support flange 126 (see FIG. 3*c*).

The horizontal flange 120 defines an opening through which passes one or more electrical cables 36 as well as the inlet pipe 54 and outlet pipe 56 of the circulating means 50. The electrical cable 36 is electrically connected to stator end turn 130 which is connected to stator winding 131 of the energizing means 32 of the electric motor 30 (FIG. 3*c*). Leakage from motor space 39 of non-hazardous liquid along the outer surface of the electrical cables 36 is resisted by compression of the cable covering by a gland 134 integral in the motor closure plate 135. A terminal box 136 is also provided within which the mechanical connection between energy source 34 and electrical cables 36 is made. It will be appreciated that the electric motor 30 is a three-phase motor, and requires an electrical cable(s) to be connected to each phase of the stator winding.

Figure 3B:
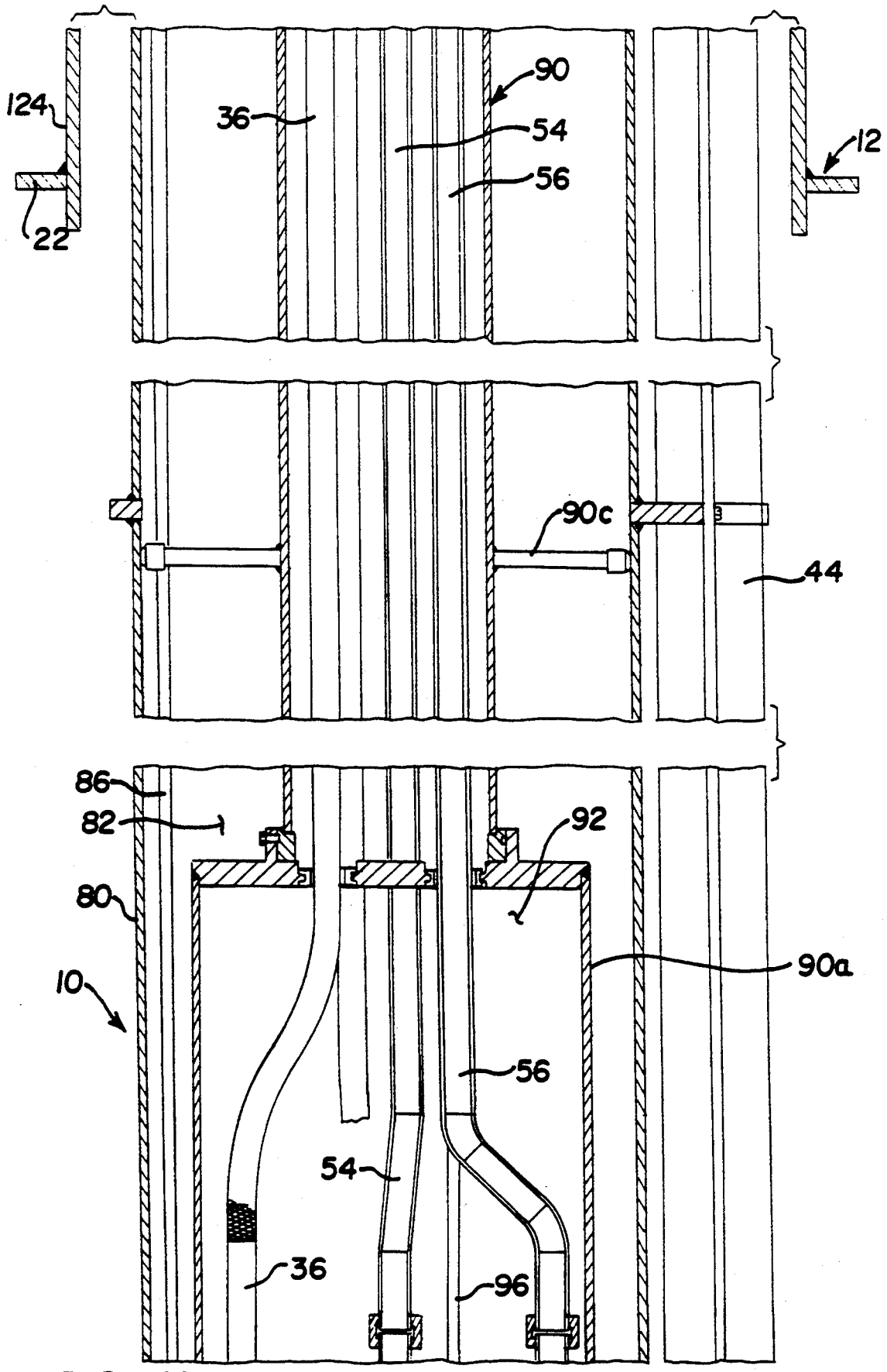
Figure 3C:
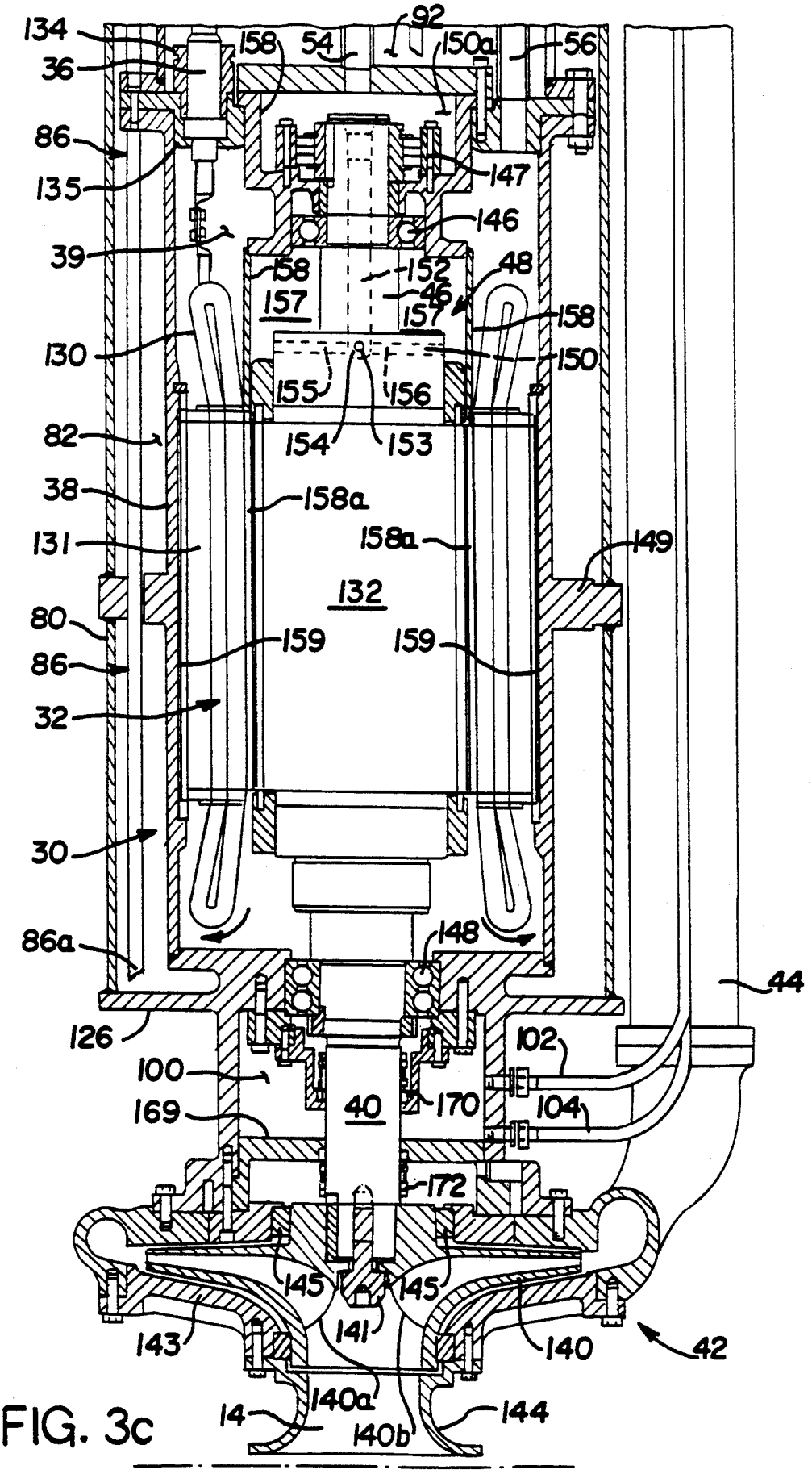

Also shown in FIG. 3*c* is the rotor 132 of the energizing means 32 of the electric motor 30. Connected to the rotor 132 is the output shaft 40 of the energizing means 32 of the electric motor 30. The output shaft 40, in turn, has mounted thereon an impeller 140 of the pump means 42. FIG. 3*c* shows leading edges 140*a* and 140*b* of the impeller 140. The impeller 140 is mounted on the output shaft 40 by an impeller bolt 141. The impeller 140 is contained in an impeller housing or casing 143 that is bolted to pump support flange 126. Bolted to the bottom portion of the impeller housing 143 is a suction bell mouth 144. The suction bell 144 is an opening for the hazardous liquid 14 to enter the pump means 42. As the hazardous liquid passes through the suction bell 144 it is accelerated and enters the impeller eye with a uniform velocity profile. The impeller imparts energy into the hazardous liquid thereby increasing the pressure of the liquid before exiting the impeller. The hazardous liquid is collected by the casing 143 and is directed into the discharge nozzle(s) of the casing 143. The discharge pipe 44 is connected to the casing 143. The hazardous liquid is conveyed through the discharge pipe 44 from the tank 18 to connection piping 19 piping arrayed on the deck 22 and thence to land-based storage 45. Two casing wear rings 145 are provided to create small clearance annuli with the impeller hubs. The purpose of these constrictions is to limit the quantity of liquid recirculated within the pump space 42. Non-sparking material pairs are used for this application.

Still referring to FIG. 3*c*, the electric motor means includes two sets of bearings, a first set 146 being mounted on the auxiliary shaft 46 and a second set 148 being mounted on the output shaft 40. These bearings resist radial and axial forces imposed by the pump means 42 and the rotating assembly. A cam clutch 147 is also provided to prevent reverse rotation.

FIG. 3*c* also shows the motor housing 38 of the electric motor 30. The motor housing 38 surrounds the energizing means 32 and defines a motor space 39. The motor housing 38 has an annular flange 149 that is welded to the outer shell 80. This provides support for the motor 30 and pump means 42. Disposed in the motor space 39 is the non-hazardous liquid that is supplied by the circulating means 50. The non-hazardous liquid can be a mineral oil or any heat transfer liquid that has good lubrication properties and displaces oxygen in the motor housing 38 so that explosions due to an electrical spark caused by failure of the electric motor 30 is resisted. The non-hazardous liquid also is a lubricant that lubricates the bearings 146 and 148 and other parts of the energizing means 32. Another function of the non-hazardous liquid is that it absorbs heat that is produced in the energizing means 32 by the inevitable efficiency of the conversion process of converting electrical energy into mechanical energy and friction and windage losses. Finally, the non-hazardous liquid functions as a dielectric insulator between the motor housing 38 and the electrical cable 36 connections to the stator end turn such as stator end turn 131.

As was discussed above, the non-hazardous liquid is circulated through the motor housing 38 by circulating means 50. The non-hazardous liquid is delivered to the motor space 39 through inlet pipe 54 and into auxiliary pump 48 where it is circulated through the motor and exits motor space 39 into outlet pipe 56 and then into heat exchanger 52 (FIG. 2). The pumping of the non-hazardous liquid is accomplished by auxiliary pump 48, which consists of an auxiliary impeller 150 mounted on the auxiliary shaft 46. As can be seen in FIG. 3*c*, the inlet pipe 54 delivers the non-hazardous liquid to a reservoir 150*a*. The non-hazardous liquid then flows into a hollowed-out section 152 of the auxiliary shaft 46. The non-hazardous liquid flows through hollow section 152 of auxiliary shaft 46 and out of four radial passages 153, 154, 155 and 156 which constitutes the impeller 150 of the auxiliary pump means 48. The non-hazardous liquid then is delivered (by centrifugal force) into reservoir 157 formed by annular partition 158 for subsequent circulation in the motor space 39.

Figure 4:
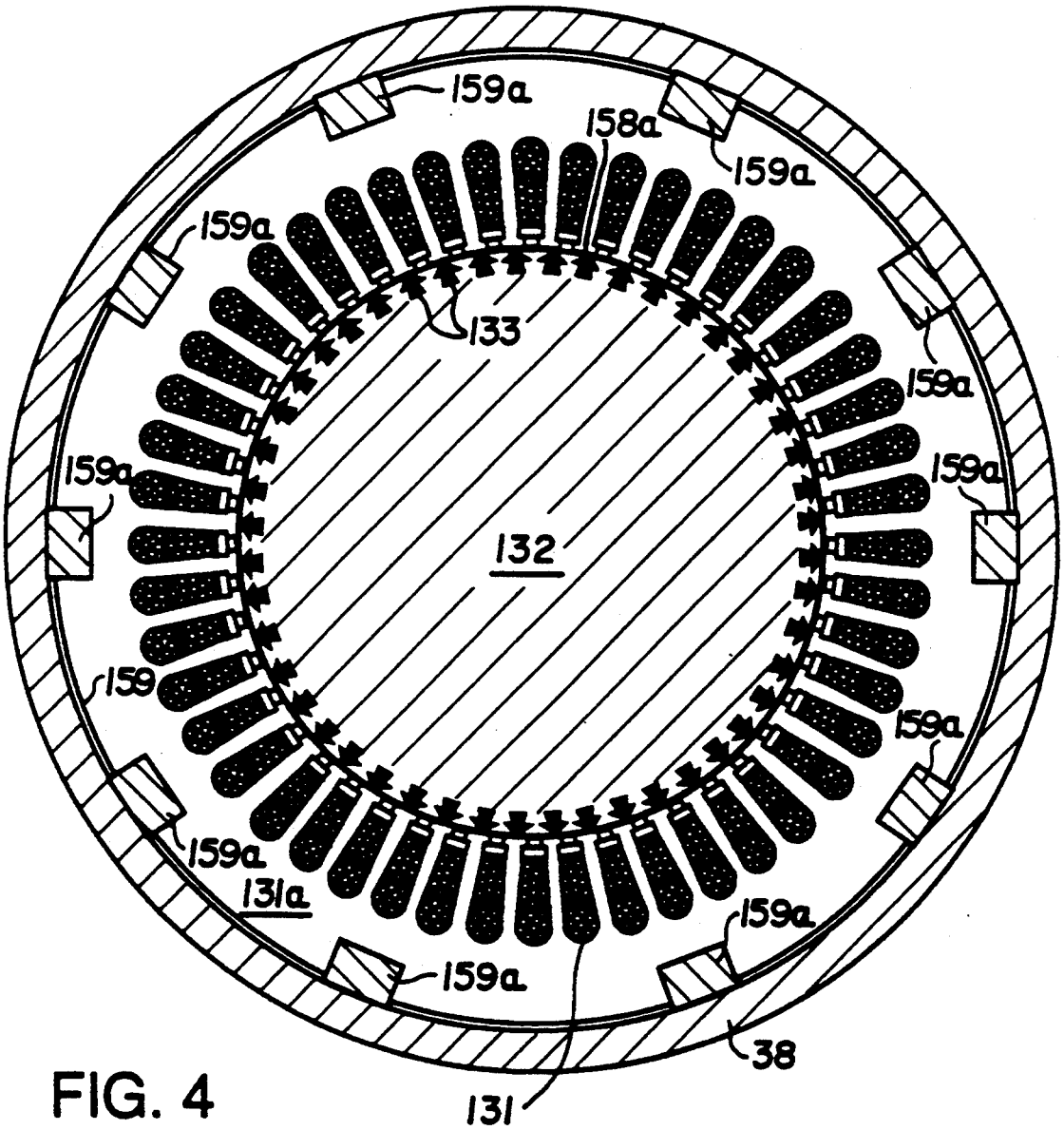
FIG. 4 is a horizontal section of the pump through the motor housing, stator lamination, stator iron and rotor.

After leaving the reservoir 157, the non-hazardous liquid flows through annulus 158*a* formed between the rotor 132 and the stator windings 131. The non-hazardous liquid picks-up the heat generated in this area and then flows to the bottom of the motor space 39 (see arrows on FIG. 3*c*). From there, the non-hazardous liquid flows in a series of passageways formed between the outer surface of the stator lamination 131*a* (FIG. 4) and the motor housing 38 picking up additional heat from the stator laminations. Referring to FIG. 4, which shows a representative horizontal section through the motor housing 38, stator lamination 131*a*, stator windings 131, rotor 132 and rotor bars 133, the passageway 159 is formed by a series of elongated building bars 159*a* that are embedded in the stator lamination 131*a* and extend from the outer surface of the stator lamination 131*a* to contact motor housing 38. FIG. 4 also shows the annulus 158*a* where non-hazardous liquid from the auxiliary pump means 48 flows down between the rotor 132 and stator windings 131 through passageway 159 for subsequent return to the outlet pipe 56 and then heat exchanger 52.

Referring now to FIG. 3*b*, the outer shell 80 defines an outer space 82. Inert gas from an inert gas supply 60 (see FIG. 2) is delivered by gas line 84 (FIG. 3*a*) into the motor space 82 through port 160. The displaced air in the motor space 82 is discharged through outlet tube 86.

Conduit shell 90 is shown in FIGS. 3*a* and 3*b*. The conduit shell 90 has a lower section 90*a* and an upper section 90*b*. It will be appreciated that upper section 90*b* has a reduced diameter that surrounds the inlet pipe 54 and outlet pipe 56 and electrical cables 36. The increased diameter lower section 90*a* starts at the point where the inlet pipe 54, outlet pipe 56 and electrical cables 36 diverge to be connected to the motor 30. It will be appreciated that this structure is used in order to cut down on the amount of metal used to form the upper section 90*b*. The conduit shell 90 is supported by braces 90*c* welded to conduit shell 90. The end portion of the upper section 90*b* is free to move in the opening in flange 120 in order to accommodate thermal expansion. O-ring seals are used at each end of conduit shell 90 to seal the conduit space 92 from outer space 82.

Similarly to outer shell 80 defining outer space 82, conduit shell 90 defines a conduit space 92. Inert gas from inert gas supply 60 is delivered by gas line 94 through port 162. The displaced air in the conduit space 92 is discharged through outlet tube 96 (FIG. 3*b*) into exhaust trap 88. The process of evacuating the outer area 82 and conduit space 92 of oxygen was described above with reference to FIG. 2 and will not be repeated here.

In accordance with the invention, the pressure of gas in outer space 82 and conduit space 92 is generally equal. These pressures are also greater than the hydrostatic pressure of the hazardous liquid 14. In this way, any leakage in the pump 10 is from the pump 10 into the hazardous liquid and not from the hazardous liquid into the pump. This will further resist the hazardous liquid from coming into motor space 39 so as to prevent explosions due to the presence of the hazardous liquid in the vicinity of the electric motor 30.

As was discussed generally with respect to FIG. 2, a collection reservoir 100 is disposed between the electric motor 30 and the pump 42. Referring now to FIG. 3*c*, a horizontal partition 169 defines the lower surface of the collection reservoir 100. A first mechanical seal 170 is disposed on the output shaft 40 of the electric motor 30 to resist leakage of the non-hazardous liquid from the motor housing 38. A second mechanical seal 172, spaced from first mechanical seal 170, is disposed on the output shaft 40 of the electric motor 30 to resist leakage of the hazardous liquid from the pump means 42. The mechanical seals 170 and 172 deliberately allow minute amounts of liquids in the motor housing and the pump means to come between them and rotating output shaft 40, thus creating a liquid film. Any leakage from the motor housing 38 and/or pump means 42 is purged from the collection reservoir 100 by the purging means consisting of gas line 102 from nitrogen gas supply 60 which introduces nitrogen gas into the collection reservoir 100 and purge line 104 which carries the purged liquid and vapors from the collection reservoir to the exhaust trap 88. As can be seen in FIG. 3*c*, the gas line 102 and purge line 104 are disposed adjacent to the surface of cargo line 44.

The pressure of the gas in the collection reservoir 100 is less than the pressure of the non-hazardous liquid in the motor housing 38. The pressure of the gas in the collection reservoir 100 is also less than the pressure of the hazardous liquid at the pump means 42. In this way, any leakage of non-hazardous liquid will go from the motor space 39 into the collection reservoir 100 and any leakage of hazardous liquid from the pump will go from the pump means into the collection reservoir 100. This will prevent the hazardous liquid from entering into the motor housing 38 as well as preventing any non-hazardous liquid from escaping into the hazardous liquid 14 and contaminating the same.

It will be appreciated that an electric motor driven pump has been disclosed which can be safely used in pumping hazardous liquids, such as petroleum products, from tanks on ocean liners and the like.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. An electric motor driven pump for pumping a hazardous liquid, said pump comprising:

electric motor means including a housing, energizing means surrounded by said housing and a rotatable output shaft extending from said housing, said housing containing a non-hazardous liquid that displaces oxygen in said housing so that explosions due to an electrical spark caused by failure of said electric motor means are resisted;

impeller means connected to said output shaft for pumping said hazardous liquid; and an outer shell surrounding said electric motor means, said outer shell and said electric motor means defining an outer space which contains an inert atmosphere and which isolates said electric motor means from said hazardous liquid that is being pumped so that explosions due to an electrical spark caused by failure of said electric motor means and the presence of a hazardous liquid vapor are further resisted.

2. The pump of claim 1, wherein said electric motor means and said impeller means are adapted to be submersed in said hazardous liquid.

3. The pump of claim 1, including means for circulating said non-hazardous liquid through said housing.

4. The pump of claim 3, wherein said circulating means includes heat exchanger means for cooling said non-hazardous liquid, an inlet pipe for transporting said non-hazardous liquid from said heat exchanger means to said housing, an outlet pipe for transporting said non-hazardous liquid from said housing and returning said non-hazardous liquid to said heat exchanger means and auxiliary pump means operatively associated with said electric motor means for pumping said non-hazardous liquid from said inlet pipe through said housing and out of said housing through said outlet pipe to said heat exchanger means.

5. The pump of claim 4, wherein said heat exchanger means includes a shell and tube heat exchanger which is not disposed in said hazardous liquid, said shell and tube heat exchanger receives said non-hazardous liquid from said outlet pipe, cools said non-hazardous liquid and discharges said non-hazardous liquid into said inlet pipe.

6. The pump of claim 4, wherein said electric motor means includes an auxiliary shaft extending from said energizing means, said auxiliary shaft defining a passageway which receives said non-hazardous liquid from said inlet pipe and discharges said non-hazardous liquid to said auxiliary pump means; and said auxiliary pump means includes an auxiliary pump impeller defining a shaft hole in which said auxiliary shaft is mounted, said auxiliary pump impeller receiving said non-hazardous liquid from said auxiliary shaft and discharging said non-hazardous liquid into said housing.

7. The pump of claim 6, wherein said auxiliary pump impeller has a plurality of radial passages extending from said shaft hole for transporting said non-hazardous liquid from said auxiliary shaft to said housing.

8. The pump of claim 4, wherein said electric motor means includes electrical cables for delivering electrical energy to said energizing means; and a conduit shell disposed inside said outer shell, said conduit shell defining a conduit space which surrounds at least portions of said inlet pipe, said outlet pipe and said electrical cables, said conduit space containing an inert atmosphere so that explosions due to an electrical spark caused by failure of said electric motor means are further resisted.

9. The pump of claim 8, wherein said heat exchanger means includes a head tank which communicates with said outlet pipe and said inlet pipe, said head tank containing a supply of said non-hazardous liquid and a pressurized inert gas to maintain said non-hazardous liquid in said housing at a constant pressure.

10. The pump of claim 9, including first purging means for purging gas and liquid from said outer space;

second purging means for purging gas and liquids from said conduit space; and exhaust trap means operatively associated with said first purging means and said second purging means for (i) receiving said purged gas and liquid, (ii) venting said purged gas, and (iii) collecting said purged liquid for subsequent removal therefrom.

11. The pump of claim 10, wherein said inert atmosphere in said outer space has a first gas pressure and said inert atmosphere in said conduit space has a second gas pressure;

said first gas pressure is generally equal to said second gas pressure; and said first and second gas pressures are both greater than a hydrostatic pressure of said hazardous liquid, wherein any leakage in said pump is from said pump into said hazardous liquid so that said hazardous liquid is resisted from entering said conduit space and said outer space.

12. The pump of claim 11, including a first mechanical seal disposed on said output shaft to resist leakage of said non-hazardous liquid from said housing;

a second mechanical seal disposed on said output shaft and spaced from said first mechanical seal to resist leakage of said hazardous liquid from said impeller means; and a collection reservoir disposed between said electric motor means and said impeller means between said first mechanical seal and said second mechanical seal for receiving any leaked non-hazardous liquid from said electric motor means and any leaked hazardous liquid from said impeller means.

13. The pump of claim 12, including third purging means for purging gas and liquid from said collection reservoir; and said third purging means being operatively associated with said exhaust trap means.

14. The pump of claim 13, including inert gas supply means for supplying inert gas to said outer space, said head tank and said conduit space.

15. The pump of claim 14, wherein said first purging means includes inlet means for introducing inert gas from said inert gas supply means into said outer space and exhaust means for receiving liquid and gas contained in said outer space which is displaced from said outer space due to the introduction of said inert gas into said outer space.

16. The pump of claim 15, wherein said exhaust means of said first purging means is a tube having a first end connected to said exhaust trap means and a second open end disposed in said outer space.

17. The pump of claim 15, wherein said second purging means includes inlet means for introducing inert gas from said inert gas supply means into said conduit space and exhaust means for receiving liquid and gas contained in said conduit space which is displaced from said conduit space due to the introduction of said inert gas into said conduit space.

18. The pump of claim 17, wherein said exhaust means of said second purging means is a tube having a first end connected to said exhaust trap means and a second open end disposed in said conduit space.

19. The pump of claim 18, wherein said third purging means includes (i) an inlet pipe having a first end connected to said inert gas supply means and a second end communicating with said collection reservoir and (ii) an outlet pipe having a first end communicating with said collection reservoir and a second end connected to said exhaust trap means.

20. The pump of claim 19, wherein said inert gas contained in said collection reservoir has a third gas pressure;

said non-hazardous liquid in said housing has a fourth pressure;

said third gas pressure is less than said fourth pressure so that any leakage of said non-hazardous liquid in said electric motor means is from said housing into said collection reservoir; and said hazardous liquid having a pressure at said impeller means that is greater than said third gas pressure so that any leakage in said impeller means is from said impeller means into said collection reservoir.

* * * * *